United States Patent [19]

Mooney et al.

[11] 4,341,851

[45] Jul. 27, 1982

[54] ELECTROPHOTOGRAPHIC PHOTOCONDUCTOR COMPRISING CDS AND ZNS

[75] Inventors: John B. Mooney, Saratoga; Ivor Brodie, Palo Alto, both of Calif.

[73] Assignee: Savin Corporation, Valhalla, N.Y.

[21] Appl. No.: 236,739

[22] Filed: Feb. 23, 1981

Related U.S. Application Data

[63] Continuation-in-part of Ser. No. 147,704, May 8, 1980, abandoned.

[51] Int. Cl.[3] ..... G03G 5/082

[52] U.S. Cl. ..... 430/56; 430/58; 430/59; 430/60; 430/95; 430/88; 430/89; 430/90; 430/94

[58] Field of Search ..... 430/57, 58, 60, 63, 430/86, 88, 94, 95, 56, 59, 89

[56] References Cited

U.S. PATENT DOCUMENTS 3,676,210 7/1972 Shattuck et al. ..... 430/127

*Primary Examiner*—John D. Welsh

*Attorney, Agent, or Firm*—Shenier & O'Connor

[57] ABSTRACT

An electrophotographic photoconductor, formed on a conductive substrate by spray pyrolysis, comprising essentially a major amount of cadmium sulphide and a minor amount of zinc sulphide. The cadmium layer is at least three microns in thickness and is formed in three zones. The zone adjacent the metal substrate, adapted to form a contact layer, bears an amount of lead sulphide; the outermost zone, adapted to absorb light, is doped with a minor amount of copper to eliminate fatigue; and the intermediate zone, which is necessary to increase the surface potential, is adapted to transport light-generated charge and is doped with a minor amount of chlorine. The process is carried on in the atmosphere with three different aqueous solutions of reagents to form the three different zones. The photoconductive layer is microcrystalline in structure and bears adsorbed oxygen.

12 Claims, 5 Drawing Figures

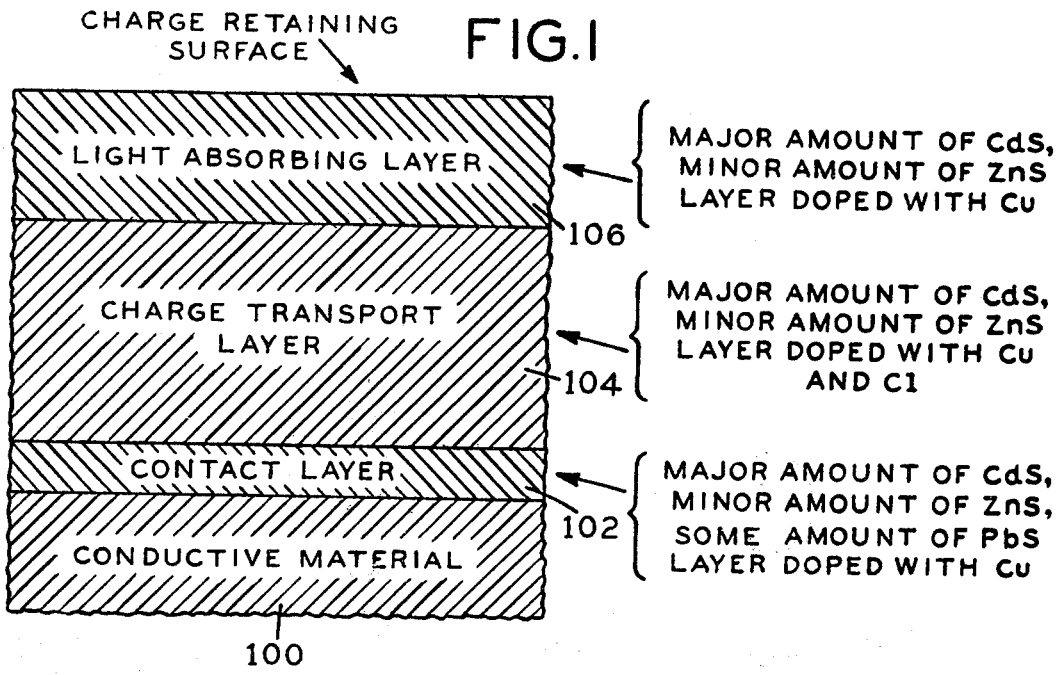
CHARGE RETAINING SURFACE
FIG.1
LIGHT ABSORBING LAYER
MAJOR AMOUNT OF CdS, MINOR AMOUNT OF ZnS LAYER DOPED WITH Cu
106
CHARGE TRANSPORT LAYER
MAJOR AMOUNT OF CdS, MINOR AMOUNT OF ZnS LAYER DOPED WITH Cu AND Cl
104
CONTACT LAYER
MAJOR AMOUNT OF CdS, MINOR AMOUNT OF ZnS, SOME AMOUNT OF PbS LAYER DOPED WITH Cu
102
CONDUCTIVE MATERIAL
100

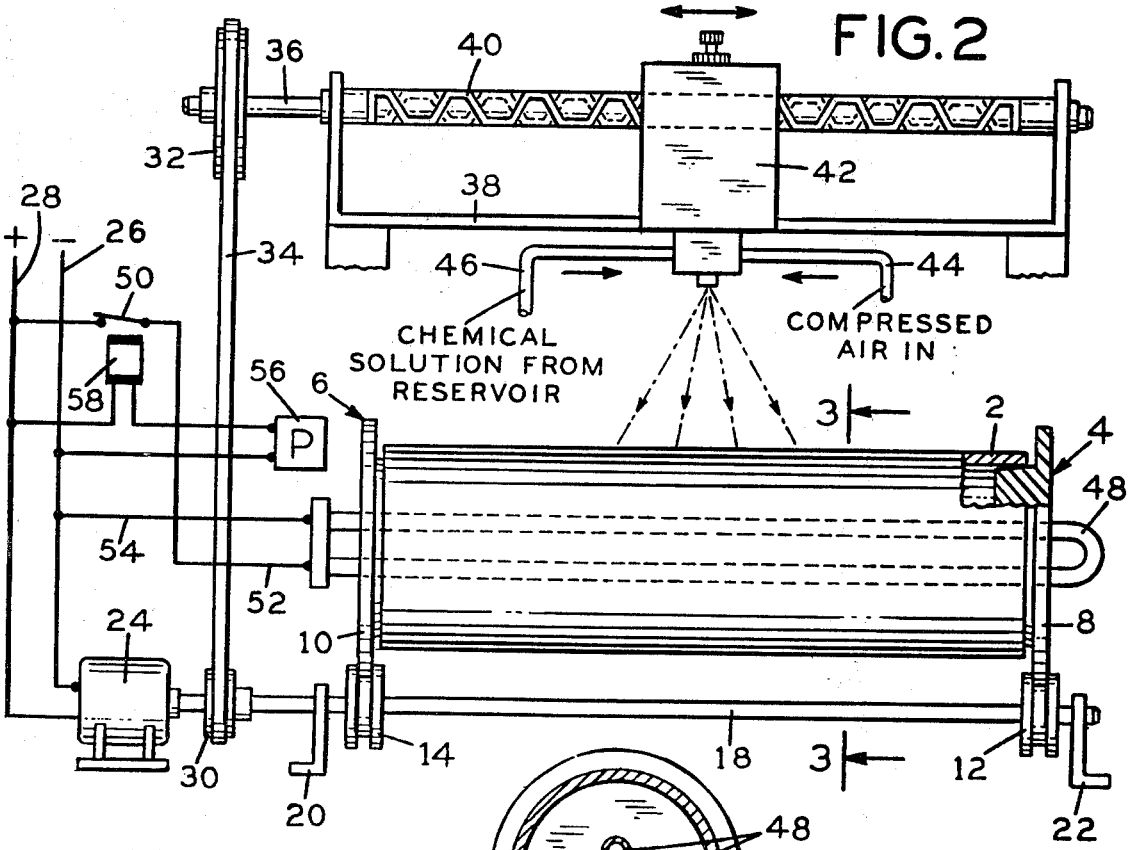
FIG.2
36
40
32
38
42
28
+
−
26
34
46
44
50
CHEMICAL SOLUTION FROM RESERVOIR
COMPRESSED AIR IN
58
56
6
P
3
2
4
48
54
52
24
10
8
30
14
18
3
12
20
22

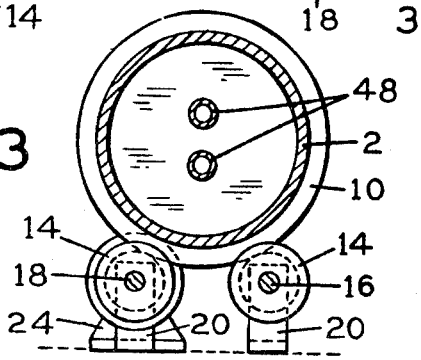
FIG.3
48
2
10
14
14
18
16
24
20
20

FIG. 4
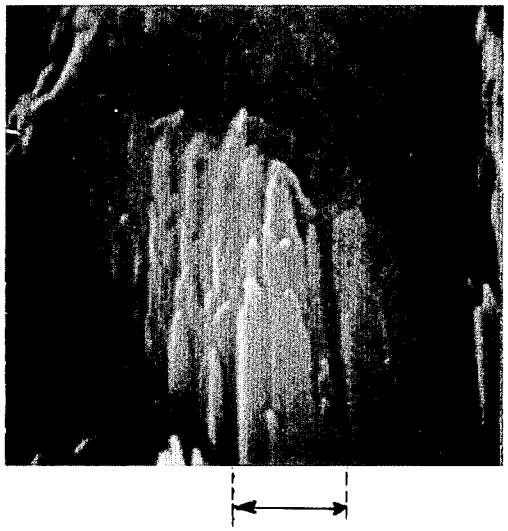
1 MICRON
20,000 X MAGNIFICATION
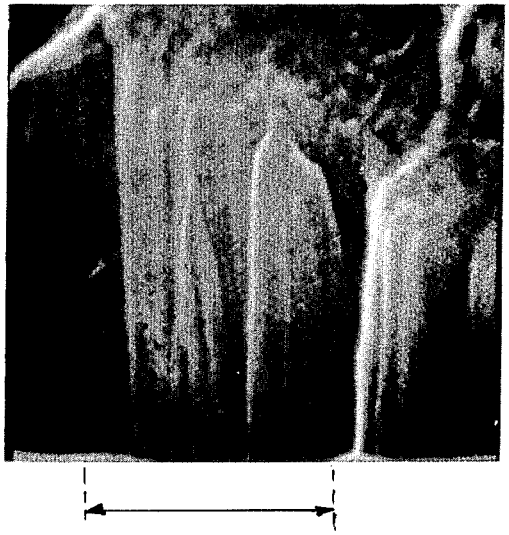
1 MICRON
50,000 X MAGNIFICATION
FIG. 5

ELECTROPHOTOGRAPHIC PHOTOCONDUCTOR COMPRISING CdS AND ZnS

CROSS-REFERENCE TO RELATED APPLICATION

This application is a continuation-in-part of our copending application, Ser. No. 147,704, filed May 8, 1980, now abandoned, for "Improved Electrophotographic Photoconductor".

BACKGROUND OF THE INVENTION

In conventional electrophotography, a photoconductive surface is charged in the dark and then subjected to a light image of the document or photograph which is to be reproduced, generating a latent electrostatic image corresponding to the original document or photograph. The latent electrostatic image is then made visible by toning with electroscopic particles. The most widely used photoconductor in electrophotographic machines is a vitreous or, more commonly called, amorphous selenium. Its sensitivity, however, is chiefly in the ranges of blue to yellow, and the gray scale is such that copies of photographs are very poor. Furthermore, a selenium photoconductor cannot be heated to a temperature of over 80° C. without losing its electrophotographic properties. The chief disadvantage of a selenium photoconductor is that it wears rapidly in an electrophotographic machine and must be replaced after use for between ten thousand and one hundred thousand copies. The addition of tellurium, arsenic, and other dopants to amorphous selenium is known in the art to effect some improvement on these properties, but substantial improvement is desirable, particularly in the wear characteristics.

Cadmium sulphide has a hardness of between 3 and 3.5 on Moh's scale of hardness. Its spectral response, when properly formed and doped, is across the entire visible range from blue to red. It has a higher effective quantum efficiency—that is, the ability to convert light into charge—from twice to ten times that of selenium. Its light discharge characteristic is such that it produces an excellent gray scale, enabling it to make excellent reproductions of photographs.

A photoconductor, in an electrophotographic process, is mounted on a conductive substrate and charged by a charging corona. The corona ionizes the air. This ionized air acts as one plate of a capacitor, the other plate being the conductive substrate. Since a photoconductor is a dielectric in the dark, the charge from the corona sticks to the surface of the photoconductor. This induces a charge of opposite polarity on the conductive substrate. The time it takes to tone a latent electrostatic image on the surface of a photoconductor is dependent on the voltage to which it may be charged.

The prior art has recognized the advantages of polycrystalline cadmium sulphide as a photoconductor. Unfortunately, the prior art (Kuehnle U.S. Pat. No. 3,884,787) has been unable to form a photoconductor of cadmium sulphide of adequate thickness to create a sufficiently high voltage at the surface with the required charge densities. This means that the development of a latent electrostatic image produced on the surface of the photoconductor will take an inordinately long time for practical use. When it is attempted to make a photoconductor of cadmium sulphide thick, it flakes from the conductive substrate or cracks.

Corrsin U.S. Pat. No. 3,151,982 attempted to overcome the short life of a vitreous selenium photoconductor by using cadmium sulphide particles in a glass binder. Lane U.S. Pat. No. 3,510,298 also discloses a cadmium sulphide photoconductor in a glass binder. We have found that glass-bound cadmium sulphide does not produce a commercially usable electrophotographic photoconductor. The latent electrostatic images, when developed, were full of spots which spoiled the images.

The prior art had developed two techniques for obtaining cadmium sulphide photoconductors without the use of binders. The first of these is described by Hill et al in U.S. Pat. No. 3,148,084. The prior art, in respect of obtaining photoconductive films, is discussed in this patent, and the disadvantages of the evaporation process, the chemical deposition process, and the vapor-reaction process are pointed out. Hill et al disclose the formation of photoconductive films by spraying reagents on a heated substrate. Their films include sulphides of many metals, as well as sulphoselenides of cadmium, cobalt, and indium. The photoconductive films were formed on an insulating substrate. Co-inventor Chamberlin further described the method in the *Journal of the Electrochemical Society,* Volume 113, pages 86–89, in an article written with J. S. Skarman in 1966. The films were not intended to be used for electrophotography, but, rather, in the manufacture of thin-film solar cells. These photovoltaic converters were formed by a thin film of copper sulphide ($0.1\mu$) together with a thin film of cadmium sulphide ($1\mu$).

Another method of forming thin-film photoconductors is by sputtering. This process is described by Kuehnle in U.S. Pat. No. 3,884,787. Films having a thickness up to $0.5\mu$ (5000 Å) were formed. These films were transparent to yellow light and were excellent photoconductors.

A charged photoconductor in the dark is analogous to a charged capacitor in which the photoconductor is the insulating or dielectric medium. In order to achieve a rapid development, a high voltage is necessary to attract toner particles from a large distance. In the case of cadmium sulphide, the corona charge is negative, so the charge of the toner particles of the developer is positive. The speed at which the charged toner particles in the developing liquid move to the latent electrostatic image on the photoconductor is a function of the voltage of the latent electrostatic image. The higher the voltage, the speedier will be the development. With a thin-film photoconductor, a surface charge density above a certain value cannot be maintained, and the excess charge is transported across the dielectric. The voltage generated at the maximum charge level is proportional to the thickness of the photoconductive layer and inversely proportional to the dielectric constant. Thus, in order to provide the high voltages required for fast toning, we seek to increase the charge density accepted by the surface and to make the film as thick as possible. When we attempted to form a thicker film by carrying on the pyrolytic formation of cadmium sulphide from aqueous solutions of reagents to a greater extent, the film flaked off the conductive substrate.

Shattuck et al U.S. Pat. No. 3,676,210 discloses a recognition of the defects in Hill et al 3,148,084, for use as an electrophotographic photoconductor, and attempts to overcome these disadvantages of a thin film by using a resin binder. In Shattuck et al, the inventors use an aqueous emulsion of polyvinyl acetate in the method disclosed by Hill et al and obtain a resin-bound cadmium sulphide photoconductor. There is no disclosure of the use of zinc or of copper as dopants. Reference is made, in Shattuck et al, to Middleton et al U.S. Pat. Nos. 3,121,006 and 3,121,007, both of which disclose a photosensitive layer consisting of an inorganic photoconductive powder dispersed in a resin binder. Shattuck et al merely use the Hill et al process to manufacture the Middleton et al products. Shattuck et al set forth that the photoconductive compounds which are formed by their method are not crystalline, but are, instead, amorphous.

Cadmium sulphide, as an electrophotographic photoconductor, has several disadvantages. First, it has a memory; that is, after charging and exposing to a light image to form a latent electrostatic image, developing that image, and transferring it to a carrier sheet, the latent image still remains on the photoconductor. Stated otherwise, the decay time in the presence of light is too slight, so that offsetting occurs. Another disadvantage of a cadmium sulphide electrophotographic photoconductor is fatigue; that is, as the photoconductor is used and reused, the maximum voltage to which it can be charged becomes less and less. Cadmium sulphide, however, can retain a much higher charge density than tellurium-doped selenium. Cadmium sulphide has a higher photosensitivity than selenium.

FIELD OF THE INVENTION

Our invention relates to an improved electrophotographic photoconductor having a spectral sensitivity across the entire visible range and a high wear resistance.

DESCRIPTION OF THE PRIOR ART

The prior art, which has been discussed above in connection with the background of the invention, is:

Hill et al—U.S. Pat. No. 3,148,084
Corrsin—U.S. Pat. No. 3,151,982
Lane—U.S. Pat. No. 3,510,298
Shattuck et al—U.S. Pat. No. 3,676,210
Kuehnle—U.S. Pat. No. 3,884,787
Chamberlin et al—Journal of the Electrochemical Society, Volume 113, pages 86–89

None of the prior art teaches a cadmium sulphide electrophotographic photoconductor having a thickness, without the use of a binder, of at least three microns.

Marlor et al U.S. Pat. No. 3,754,985 discloses a process of making a sintered photoconductor comprising cadmium sulphide doped with copper and chlorine.

Chamberlin et al disclose the use of cadmium acetate and thiourea or N,N dimethyl thiourea. This reference also shows the doping of a cadmium sulphide film with copper, as well as the fact that, with cadmium acetate as a starting material, crystallites smaller than 400 Å in size are formed.

SUMMARY OF THE INVENTION

In general, our invention contemplates an electrophotographic photoconductor comprising, essentially, cadmium sulphide having a thickness of three microns or more, formed by spray pyrolysis of an aqueous solution of cadmium acetate and thiourea. A minor amount of zinc sulphide is codeposited by the addition of zinc acetate in the reagent solution to raise the acceptance potential of the photoconductor. A minor amount of copper is used as the dopant to improve the spectral response, to reduce memory which causes offsetting when in use, and to reduce fatigue. The copper dopant is codeposited by adding copper acetate to the solution being sprayed in the pyrolytic spray process. The spraying takes place on a heated metal surface such as steel or aluminum, preferably chromium or cadmium plated for adhesion and corrosion control. The spray pyrolysis takes place in three stages. In the first stage, an amount of lead acetate is added to the spraying solution to make an appropriate contact layer and to eliminate the white spots on the black parts of the copy. In the second stage, the lead acetate is eliminated and chlorine is added in the form of cadmium chloride. The chlorine acts as a dopant to assist the transport of photogenerated charge to the substrate, as well as to assist in the removal of memory and fatigue. It also increases the number of carriers. This stage of photoconductor formation is carried on as long as feasible to increase the thickness of the photoconductor and hence enable it to accept a higher level of charge then theretofore possible with cadmium sulphide photoconductors. The first part of the process is carried on to produce a layer having a thickness of about 3,000 Å. The second layer, which is a charge transport layer, is carried on until it has a thickness of about 17,500 Å. The solution is then changed to remove the chlorine dopant, so that the solution comprises only cadmium acetate, copper acetate, and zinc acetate with thiourea. The formation of the third layer, which is the light-absorbing portion of the photoconductor, is carried on until it has a thickness of about 9,500 Å, sufficient to absorb almost all the light incident on the surface. The finished photoconductor can be charged to a very high level and has an excellent light response which enables it to produce a high-contrast image having a superior gray scale. The photoconductor has a very long shelf life which is not affected by temperature or humidity.

The layers may be formed on any suitable substrate, preferably on a cylinder which is to be used in an electrophotographic machine. The cylinder is rotated while being heated by means of a radiant heat element to a temperature of between 125° C. and 200° C. (±25° C.), measured at the surface of the drum. The solutions are sprayed at the rate of about 300 cc. per hour.

The spraying takes place in the presence of the atmosphere, which contains oxygen. The oxygen appears to be adsorbed on the surface of the crystals. It is advantageous because it apparently increases the resistivity of the cadmium sulphide film.

OBJECTS OF THE INVENTION

One object of our invention is to provide a cadmium sulphide electrophotographic photoconductor having improved wear characteristics.

Another object of our invention is to provide a cadmium sulphide electrophotographic photoconductor having a uniform spectral response across the entire visible range from blue to red.

Still another object of our invention is to provide a cadmium sulphide electrophotographic photoconductor having a higher effective quantum efficiency.

A further object of our invention is to provide a cadmium sulphide electrophotographic photoconductor in which the latent electrostatic image may be readily erased with visible light.

A still further object of our invention is to provide a cadmium sulphide electrophotographic photoconductor having high charge acceptance properties in the dark.

An additional object of our invention is to provide a cadmium sulphide electrophotographic photoconductor of sufficient thickness to create a high voltage when charged to its highest level.

Still another object of our invention is to provide a cadmium sulphide electrophotographic photoconductor which is substantially unchanged by environmental factors, such as temperature and humidity, in normal climatic conditions.

Other and further objects of our invention will appear from the following description.

BRIEF DESCRIPTION OF THE DRAWINGS

In the accompanying drawings, which form part of the instant specification and which are to be read in conjunction therewith, and in which like reference numerals are used to indicate like parts in the various views:

FIG. 1 is a diagrammatic view, drawn on an enlarged scale, showing a fragment of our improved photoconductor.

FIG. 2 is a diagrammatic view of an apparatus capable of manufacturing the photoconductor shown in FIG. 1.

FIG. 3 is a sectional view, taken along the line 3—3 of FIG. 2.

FIG. 4 is a photomicrograph of crystals exposed from a bulk of our improved cadmium sulphide photoconductor, photographed on a magnification of twenty thousand times.

FIG. 5 is a view, similar to FIG. 4, of another portion of a bulk of our improved cadmium sulphide photoconductor, photographed on a magnification of fifty thousand times.

DESCRIPTION OF THE PREFERRED EMBODIMENT

More particularly, in forming our improved electrophotographic photoconductor, we employ a spray pyrolysis process which is known to the art. The apparatus for forming the photoconductor is shown in FIG. 2, in which a metal drum 2, formed of aluminum or mild steel, is plated with chromium or cadmium. It is thoroughly cleaned before starting the process, first with nitric acid, then with water, and then with household detergent, until no oil or grease is present. The presence of oil on the surface of the drum can be detected by the break test; that is, a drop of water will break into an even film on the surface when it is completely oil-free. After this, the surface is rinsed with deionized water and then with isopropyl alcohol to clean off the water. In the many photoconductors which we made, we employed a chromium-plated drum for corrosion control. We have found, however, that a better bond is created with cadmium plating.

The drum 2 is mounted on a pair of fixtures 4 and 6 into which the drum may be fitted by friction, as can readily be seen by reference to FIG. 2 of the drawings. The fixtures 4 and 6 are provided with flanges 8 and 10 which engage two pairs of rotary saddles 12 and 14, shown in FIGS. 2 and 3. The saddles are mounted on a pair of shafts 16 and 18 which are carried by two pairs of pedestals 20 and 22. The shaft 16 is driven by a prime mover such as an electric motor 24 supplied with voltage through conductors 26 and 28. The shaft 16 carries a drive pulley 30 which drives a pulley 32 through a belt 34. A shaft 36 is mounted in a fixture 38 for rotation with pulley 32. It carries a double helical screw 40 adapted to reciprocate an atomizing head 42 back and forth along the fixture 38. Attached to the atomizing head 42 we position a pair of flexible hoses 44 and 46. The hose 44 is connected to a source of compressed air (not shown) having a pressure in the order of twenty pounds per square inch. The hose 46 communicates with the aqueous reagent solutions which are used successively to obtain the three differing cadmium sulphide compositions forming the improved electrophotographic photoconductor. The reagent solutions may be fed by gravity or by air pressure, or in any other appropriate manner known to the art. The rate of flow is governed by a valve (not shown) positioned between the reagent-solution supply and the atomizing head 42 and is controlled to form a spray, at the rate of 300 cc. or less per hour, of reagent for contact with the drum 2. A resistance heating element 48 is positioned in the interior of the rotating drum 2. Current flows from the conductor 28, connected to the source of potential, through armature 50 of a relay, through conductor 52, through the heating element 48, through conductor 54 to complete the circuit through conductor 26 to the source of potential. A pyrometer 56 is positioned to sense the temperature on the surface of the drum 2 being coated. It is set to a temperature between 130° C. and 180° C. If the temperature becomes too high, a winding 58 of the relay opens the circuit by lifting armature 50. When the temperature cools to within the desired range, the winding 58 is de-energized and the armature 50 again energizes the heating element 48. It is to be understood that any appropriate pyrometer known to the art, such as a thermistor, may be employed. The average temperature at the surface of the drum is maintained at about 150° C.

In attempting to produce a cadmium sulphide electrophotographic photoconductor, we experimented for about three years and coated in the order of five hundred test drums before determining the best mode of carrying out our invention. We soon learned that most cadmium sulphide photoconductors, while having photoconductive properties, would not be operative in the electrophotographic mode to produce an acceptable electrophotographic image when used in electrophotographic machines. Cadmium sulphide has a natural hardness and, hence, greatly improved abrasion resistance over vitreous selenium. Our improved cadmium sulphide photoconductor was able to produce over a million copies, as compared with not more than one hundred thousand copies for vitreous selenium, when used in a conventional plain-paper photocopying machine. Cadmium sulphide photoconductive films having sufficient thickness could not be formed by spray pyrolysis. If it was attempted to make the film too thick, it would flake from the metal substrate. A thin film would give rise to only a small voltage level. Furthermore, the dark decay was too high, so that it would take several passes under one corona to charge the photoconductor to the maximum level permitted by the thin layer of cadmium sulphide. Attempts to raise the voltage level would cause the cadmium sulphide photoconductor to break down. Moreover, cadmium sulphide had a memory; that is, after imagewise exposure, development, and printing on the carrier sheet, the latent image still remained on the photoconductor. The decay time in the light was too slow. We also found that, after using a cadmium sulphide photoconductor for a while, the maximum voltage to which it could be charged became less and less. We made numerous experiments to improve this situation, each of which led us to the present invention, step by step.

Cadmium sulphide is generally less sensitive to red light. The addition of copper, as is known to the art, sensitizes cadmium sulphide to red light. We found that the addition of copper also reduced fatigue and memory, and the resultant electrophotographic photoconductor was rendered sensitive across the whole spectrum, including the red area.

A good photoconductor for use in electrophotographic machines must be able to accept a voltage sufficiently high, especially when developed by electrophoresis with toner particles suspended in an insulating carrier liquid, so that development will take place rapidly. This is a function of both the thickness of the photoconductor and its dark resistance. We found that the incorporation of zinc, in the form of zinc sulphide, enabled the photoconductor to be charged to a higher voltage.

In making photoconductor-coated drums containing no zinc, the charge level was not high enough to make for rapid development. Furthermore, the contrast between the most highly exposed areas and those lesser exposed suffered. The addition of zinc made an enormous difference. The addition of zinc, however, makes the photoconductor less sensitive, especially to red, so that there is a limit, readily determined by the color response, to which zinc can be added.

One of the disadvantages of cadmium sulphide, as pointed out above, is its higher dark decay; that is, it is not as good an insulator in the dark as is required by a good and practically usable electrophotographic photoconductor. We have found that manufacture of cadmium sulphide by spray pyrolysis from the acetate greatly increases the dielectric properties of the photoconductor in the dark.

The interface between the conductive substrate and the cadmium sulphide photoconductor is important. There must be an appropriate rectifying electrical contact at this interface. We have found that by making additions to the contact layer—that is, the layer of the photoconductor in contact with the conductive substrate—specifically with lead, the proper electrical contact is obtained. Other things being equal, we found that cadmium sulphide electrophotographic photoconductors doped with copper and doped with chlorine, and containing zinc sulphide, still were unsatisfactory because light spots on the black parts of the copy appeared. After many experiments, we determined this could be caused by improper electrical contact between the photoconductor and the substrate. By adding an amount of lead, we increased the conductivity of the contact layer and the spotting was eliminated.

We determined the amount of lead empirically by adding more and more until the spots got larger and larger and an optimum value was found to obviate the spots. We did not determine the maximum amount of lead which could be used without deleterious effects.

In the prior art, oxygen was considered a disadvantage. In Hill et al U.S. Pat. No. 3,148,084, Column 4, beginning at line 62, the inventors indicate that none of the elements in the photoresponsive film are derived from the substrate or the surrounding atmosphere. The inventors further point out, in Column 7, beginning at line 65, that post film formation, they subject the photoconductor to temperatures of between 900° F. and 1,200° F. This, of course, would drive off any adsorbed oxygen. Kuehnle U.S. Pat. No. 3,884,787 forms a film by sputtering in an atmosphere of inert gas such as argon.

We have discovered, by subjecting our finished electrophotographic photoconductor to analysis by Auger spectroscopy, that there is a low amount of oxygen present. We are unable to determine the nature of the oxygen, but we believe it is adsorbed on the boundaries of the crystals which form the photoconductor. The oxygen increases the resistivity of cadmium sulphide, which usually has free electrons inside its crystals. Our hypothesis is that oxygen, adsorbed on the crystals' surface, attracts the spare electrons from the interior of the crystals and positions them on the surface of the crystals, making the crystals a better insulator in the dark. The oxygen is present in the water used to make the aqueous solutions of the reagents and is also present in the atmosphere.

While we have made a great many cadmium sulphide-coated electrophotographic drums, the best mode we have found of carrying out our invention is this: We first form an aqueous solution of a major amount of cadmium acetate and a minor amount of copper acetate, lead acetate, and zinc acetate. A separate solution of thiourea may be formed. Since the solution of metal acetates and the aqueous solution of thiourea will react slowly at room temperature, they may be introduced from separate containers into the atomizing head 42 through hose 46. The reaction is so slow, however, that this is not necessary, and a single solution may be made as follows:

SOLUTION I

Thiourea—0.008 molar
Cadmium Acetate—0.006 molar
Copper Acetate—0.00012 molar
Zinc Acetate—0.0006 molar
Lead Acetate—0.00022 molar One liter of the above solution is formed and is sprayed at the rate of about 300 cc. per hour upon the drum 2 which is being rotated at about seventeen revolutions per minute. It is to be noted, by reference to FIG. 2, that the atomizing head 42 reciprocates while the drum 2 is rotating. The rate of reciprocation is between four and five cycles per minute. If the spray is directed at one portion of the drum too long, it will cool it locally below the pyrolytic deposition temperature. It will be noted that there is an excess of thiourea in the above solution. This is used in order to drive the reaction to completion, since the law of mass action requires an excess of the driving component to compel the reaction in the desired direction. At a spray rate of 300 cc. per hour, it will take 3⅓ hours to lay down the first layer, which will have a thickness in the order of 0.3 microns. The constant change of the spray position, in respect of the substrate, produces an extremely uniform layer which is extremely smooth. No binder is used, and the cadmium sulphide region is formed having elongated crystallites about 300 Å or 400 Å in diameter. We subjected the bulk of the composite layer to a process of etching with a beam of argon ions. This process is known to the art as "argon sputter etching". FIG. 4 is a photomicrograph showing the crystalline structure of our cadmium sulphide electrophotographic photoconductor, magnified twenty thousand diameters. FIG. 5 is a view similar to FIG. 4, in which the crystalline structure is revealed in a photomicrograph magnified fifty thousand diameters. This crystalline structure prevailed throughout the composite photoconductor, the formation of which is herein described.

Since it is necessary that an electrophotographic photoconductor have sufficiently rapid light decay and be of sufficient thickness to accept a high enough charge, we of sufficient thickness to accept a high charge, we formed a different aqueous solution to produce a different region of our composite electrophotographic photoconductor. This solution is as follows:

SOLUTION II

Thiourea—0.008 molar
Cadmium Acetate—0.0055 molar
Copper Acetate—0.00012 molar
Zinc Acetate—0.0006 molar
Cadmium Chloride—0.00031 molar It will be observed that the metal salts of cadmium, zinc, and copper, used by Hill et al, are chlorides. We have found that the use of chloride salts, instead of acetate salts, produces cadmium sulphide which has a low dark resistance and will not accept a sufficiently high charge to make for rapid development of the latent electrostatic image. We use an amount of cadmium chloride as a dopant, so the residual potential is greatly reduced for a given foot-candle quantity of light. Stated otherwise, the light decay time of the region formed by SOLUTION II is greatly decreased. While the region of our improved composite electrophotographic photoconductor forming the contact layer is thin (0.3 microns), the region of our photoconductor formed with the chlorine dopant, the charge transport layer, is made to have a thickness in the order of 1.75 microns. To accomplish this, we employ a solution having a volume of six liters and continue the spray pyrolysis for an additional eighteen hours or more.

We next form the light-absorbing region of our cadmium sulphide electrophotographic photoconductor. This is accomplished by forming an aqueous solution as follows:

SOLUTION III

Thiourea—0.008 molar
Cadmium Acetate—0.006 molar
Copper Acetate—0.00012 molar
Zinc Acetate—0.0006 molar The solution is formed in a quantity of about three liters, and it takes about ten hours to form a layer under the same process conditions as the other layers described above. The light-absorbing layer will have a thickness of about 0.95 microns.

Our improved composite electrophotographic photoconductor, thus formed, is shown diagrammatically in FIG. 1. A conductive substrate 100 is formed of any appropriate metal, such as mild steel or aluminum. A contact region or layer 102 has a thickness of 3,000 Å and comprises, essentially, a major amount of cadmium sulphide, a minor amount of zinc sulphide, and a substantial amount of lead sulphide, the layer being doped with copper. It will be observed that all of the layers or regions of our composite photoconductor comprise, essentially, a major amount of cadmium sulphide with a minor amount of zinc sulphide. All of the layers are doped with copper. A charge transport layer 104 is doped with copper and chlorine and has a thickness of 17,500 Å. A light-absorbing region or layer 106 comprises a major amount of cadmium sulphide and a minor amount of zinc sulphide, the layer being doped with copper.

It will be understood that we have found it advantageous, in order to produce a practical electrophotographic photoconductor, that the composite photoconductor have a thickness of at least three microns. It will be understood, of course, that the contact layer may be made thinner, since its main function is to form an appropriate electrical contact between the conductive substrate and the composite photoconductor. It is unnecessary to make it too thick. The charge transport layer aids greatly in contributing to the desired thickness of the composite photoconductor. A thick photoconductor is necessary to increase the level of potential to which the composite photoconductor can be charged. The amount of chlorine in the charge transport layer was determined empirically.

Furthermore, cadmium chloride has a pronounced effect on dark decay, which of course is related to the rate of charging. If the charges leak off while charging, the rate of charging is correspondingly reduced. The effect of cadmium chloride is to increase the dielectric properties of the composite photoconductor in this region. We performed many tests, varying the amount of chlorine in SOLUTION II. We have found that a 25-percent shift [±] in concentration does not appear to make too much difference. Too little chlorine increases the charging time, and too much reduces the dielectric properties.

All of the regions of our composite photoconductor show the presence of oxygen, which appears to increase the resistivity of the cadmium sulphide.

We have found that our improved composite photoconductor accepts a charge as high as 300 volts; and the charge density is much higher, in our composite cadmium sulphide electrophotographic photoconductor, than selenium doped with tellurium.

We could detect no demarcation between adjacent zones or layers of our composite photoconductor. Its dark resistance was between $10^{12}$ and $10^{16}$ ohm-centimeters. This is markedly different from photovoltaic cells, which require very high conductance.

We have found that our composite photoconductor, having a thickness of between three and four microns, operates well in the electrophotographic mode. Theoretically, a thicker photoconductor would be better, but we have found that after a thickness of six microns is reached, cracks develop. A thin photoconductor cannot accept a voltage level high enough to be practical; that is, a thin photoconductor will require a longer time in developing the latent electrostatic image to which it has been subjected after charging.

It will be observed that we have described our invention in respect to thiourea as the sulphur-bearing reagent and only metal salts of cadmium. We have tried other sulphur compounds, such as N,N-dimethyl thiourea, but prefer thiourea. The dimethyl and diethyl thioureas do not produce the results as well as thiourea, but are usable. A selenourea is less suitable than thiourea. Though it is usable, it is more difficult to handle; it is less chemically stable; it tends to deposit elemental selenium; and it decomposes rapidly by itself in room light.

Copper is useful in the light-absorbing layer or zone, since it extends the spectral response to the lower wave lengths so that our finished electrophotographic photoconductor is sensitive over the entire visible range from blue to red.

The production of our cadmium sulphide photoconductor from acetate salts, instead of chloride salts, of cadmium and zinc is very important. Only in the transport layer do we use a minor amount of cadmium chloride to ensure the presence of chlorine. We have discovered that the use of cadmium sulphide, derived by spray pyrolysis from the chloride, produces a photoconductor which has a rapid dark decay; that is, its resistance or its dielectric strength in the dark is not sufficiently great to be used in the electrophotographic mode. The elimination of excess chlorine by using the acetate salts solved the problem.

The introduction of chlorine in the charge transport layer enables us to utilize a sufficiently thick photoconductor to receive a charge as high as 250 to 350 volts, which ensures rapid development with a liquid-carried toner. We have produced satisfactory electrophotographic photoconductors of composite zones, according to our invention, having a thickness between three microns and six microns. After a thickness of six microns has been reached, cracks will develop through the film.

It will be seen that we have accomplished the objects of our invention. We have provided a cadmium sulphide electrophotographic photoconductor having improved wear characteristics. A conductive drum bearing our improved photoconductor was tested in a simulated office photocopier mode and experienced over a million copies without significant wear. Our sensitivity or effective quantum efficiency is two to ten times greater than selenium. While selenium is sensitive only in the ranges from blue to yellow, our photoconductor is sensitive across the entire visible range from blue to red. Our photoconductor produces copies having photographic quality—that is, having a gray scale sufficiently graduated so that photographic reproductions are made from photographic originals. A latent electrostatic image is produced, with our photoconductor, which can be readily and rapidly toned with a liquid toner. The main fault of cadmium sulphide photoconductors—that is, the presence of memory—has been substantially eliminated, and a latent electrostatic image will decay rapidly in light. This enables us to produce copies at a high speed. A high-speed photocopying machine can be made with our photoconductor, since a thick layer of photoconductive material may be carried by a conductive substrate, enabling us to charge to a higher potential than the thin cadmium sulphide photoconductors of the prior art. Continued use of our photoconductor fails to develop significant fatigue.

A selenium photoconductor cannot be heated to over 80° C. without deleterious effects. Our improved photoconductor is unaffected by normal climatic values and has an apparently infinite storage life. The microcrystalline structure and the presence of oxygen, in our photoconductor, gives our composite photoconductor a sufficiently high insulating property in the dark—that is, a low dark decay—so that a very satisfactory latent electrostatic image can be formed from a single exposure.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. An electrophotographic photoconductor including in combination a conductive substrate having formed thereon a layer of a homogeneous alloy of metal sulphides approximately at least three microns thick, said layer comprising a major amount of cadmium sulphide and a minor amount of zinc sulphide.

2. An electrophotographic photoconductor including in combination a conductive substrate having formed thereon a layer of a homogeneous alloy of metal sulphides approximately at least three microns thick, said layer comprising a major amount of cadmium sulphide and a minor amount of zinc sulphide, said layer being doped with copper.

3. An electrophotographic photoconductor including in combination a conductive substrate having formed thereon a layer of metal sulphides approximately at least three microns thick, said layer comprising a major amount of cadmium sulphide and a minor amount of zinc sulphide, said layer having a zone adjacent said conductive substrate, said zone containing an amount of lead sulphide.

4. An electrophotographic photoconductor including in combination a conductive substrate having formed thereon a layer of metal sulphides approximately at least three microns thick, said layer comprising a major amount of cadmium sulphide and a minor amount of zinc sulphide, said layer being doped with copper, said layer having a zone in contact with said conductive substrate, said zone containing an amount of lead sulphide.

5. An electrophotographic photoconductor including in combination a conductive substrate having formed thereon a layer of metal sulphides approximately at least three microns thick, said layer comprising a major amount of cadmium sulphide and a minor amount of zinc sulphide, said layer being doped with copper and formed in three zones, one zone being in contact with the metal substrate and containing a minor amount of lead sulphide, a second zone adjacent said first zone being doped with a minor amount of chlorine, and a third zone in contact with said second zone adapted to absorb light, said second zone adapted to transport charges from the light-absorbing zone to said contact zone.

6. An electrophotographic photoconductor including in combination a conductive substrate having pyrolytically formed thereon a layer of metal sulphides from an aqueous solution of major amounts of thiourea and cadmium acetate and a minor amount of zinc acetate, said layer having a thickness of approximately at least three microns, said layer being doped with copper.

7. An electrophotographic photoconductor including in combination a conductive substrate having pyrolytically formed thereon a layer of metal sulphides deposited in at least two zones; one zone being formed from an aqueous solution containing a major amount of thiourea, a major amount of cadmium acetate, and minor amounts of copper acetate and zinc acetate; said zone being adapted to absorb light and retain a high charge level; said first zone being in contact with a second zone pyrolytically formed of an aqueous solution containing major amounts of thiourea and cadmium acetate and minor amounts of copper acetate, zinc acetate, and cadmium chloride.

8. An electrophotographic photoconductor including in combination a conductive substrate having formed thereon a layer of metal sulphides approximately at least three microns thick, said layer comprising a major amount of cadmium sulphide and minor amounts of zinc sulphide and copper sulphide, said sulphide layer having a crystalline structure, said crystals bearing adsorbed oxygen.

9. An electrophotographic photoconductor including in combination a conductive substrate having pyrolytically formed thereon a composite layer of metal sulphides deposited in three zones; the first zone being in contact with said conductive substrate and being formed by spray pyrolysis from an aqueous solution containing a major amount of thiourea, a major amount of cadmium acetate, and minor amounts of zinc acetate, lead acetate, and copper acetate; a second zone in contact with said first zone, said second zone being adapted to transport charges therethrough, said second zone being formed by spray pyrolysis from an aqueous solution containing a major amount of thiourea, a major amount of cadmium acetate, and minor amounts of copper acetate and cadmium chloride; and a third zone adapted to absorb light and retain a high surface charge being in contact with said second zone, and being formed by spray pyrolysis from an aqueous solution containing a major amount of thiourea, a major amount of cadmium acetate, and minor amounts of zinc acetate and copper acetate; said composite layer of metal sulphides being approximately at least three microns thick.

10. An electrophotographic photoconductor including in combination a conductive substrate having pyrolytically formed thereon a composite layer of metal sulphides deposited in three zones; the first zone being in contact with said conductive substrate and being formed by spray pyrolysis from an aqueous solution containing a major amount of thiourea, a major amount of cadmium acetate, and minor amounts of zinc acetate, lead acetate, and copper acetate; a second zone in contact with said first zone, said second zone being adapted to transport charges therethrough, said second zone being formed by spray pyrolysis from an aqueous solution containing a major amount of thiourea, a major amount of cadmium acetate, and minor amounts of copper acetate and cadmium chloride and a third zone adapted to absorb light, being in contact with said second zone, and being formed by spray pyrolysis from an aqueous solution containing a major amount of thiourea, a major amount of cadmium acetate, and minor amounts of zinc acetate and copper acetate; said composite layer of metal sulphides being approximately at least three microns thick, said layer being essentially doped crystalline cadmium sulphide having oxygen adsorbed on the surface of the crystals thereof.

11. An electrophotographic photoconductive assembly including in combination a substrate of conductive metal, a composite layer of crystalline metal sulphides approximately at least three microns thick carried by said substrate, said layer comprising essentially a major amount of cadmium sulphide and a minor amount of zinc sulphide and being formed in three zones; the contact zone adjacent the conductive metal substrate bearing a minor amount of lead sulphide, the outermost zone bearing a minor amount of copper, and the zone intermediate the outermost zone and the contact zone bearing a minor amount of a chloride.

12. An electrophotographic photoconductive assembly including in combination a substrate of conductive metal, a composite layer of crystalline metal sulphides approximately at least three microns thick carried by said substrate, said layer comprising essentially a major amount of cadmium sulphide and a minor amount of zinc sulphide and being formed in three zones; the contact zone adjacent the conductive metal substrate bearing a minor amount of lead sulphide, the outermost zone bearing a minor amount of copper, and the zone intermediate the outermost zone and the contact zone bearing a minor amount of a chloride, the crystals of said crystalline composite electrophotographic photoconductor bearing adsorbed oxygen.

* * * * *